US007797890B2

(12) United States Patent
Thrush et al.

(10) Patent No.: US 7,797,890 B2
(45) Date of Patent: Sep. 21, 2010

(54) INTERLOCKING FLOOR TILES WITH MUSHROOM SHAPED CONNECTORS

(75) Inventors: Bruce Thrush, Monarch Beach, CA (US); John Grimm, Santee, CA (US)

(73) Assignee: The Parallax Group International, LLC, San Juan Capistrarto, CA (US)

( * ) Notice: Subject to any disclaimer, the term of this patent is extended or adjusted under 35 U.S.C. 154(b) by 0 days.

(21) Appl. No.: 11/677,957

(22) Filed: Feb. 22, 2007

(65) Prior Publication Data

US 2007/0199257 A1 Aug. 30, 2007

Related U.S. Application Data

(60) Provisional application No. 60/776,586, filed on Feb. 24, 2006.

(51) Int. Cl.
*E04F 11/16* (2006.01)

(52) U.S. Cl. ..... 52/177; 52/591.3; 52/574; 446/116; 446/125

(58) Field of Classification Search ..... 52/180, 52/384, 578, 592.1, 586.1, 591.5, 591.3, 52/177, 574, 392, 590.1; 446/116, 118, 120, 446/121, 124, 125

See application file for complete search history.

(56) References Cited

U.S. PATENT DOCUMENTS 654,532 A * 7/1900 Furness ..... 52/575
680,468 A * 8/1901 Sierer ..... 52/311.2
1,361,501 A * 12/1920 Schepmoes ..... 52/591.3
2,999,431 A 9/1961 Mitchell
3,657,852 A 4/1972 Worthington
4,018,025 A * 4/1977 Collette ..... 52/302.4
4,030,729 A * 6/1977 Nathaniel ..... 472/90
4,226,064 A * 10/1980 Kraayenhof ..... 52/180
4,287,693 A 9/1981 Collette
5,052,158 A * 10/1991 D'Luzansky ..... 52/177
5,389,116 A * 2/1995 Byrd ..... 47/9
5,775,046 A * 7/1998 Fanger et al. ..... 52/590.1
5,791,114 A * 8/1998 Mandel ..... 52/591.3
6,526,705 B1 3/2003 MacDonald
6,588,167 B2 7/2003 Chang
6,820,386 B2 * 11/2004 Kappeli et al. ..... 52/591.4
6,993,801 B2 * 2/2006 Marko et al. ..... 14/69.5
7,284,757 B2 * 10/2007 Geissler ..... 273/157 R
7,416,363 B2 * 8/2008 Kozhuev ..... 403/364
D603,640 S 11/2009 Thrush
D604,082 S 11/2009 Thrush
D604,083 S 11/2009 Thrush

* cited by examiner

*Primary Examiner*—Richard E Chilcot, Jr.
*Assistant Examiner*—Anthony N Bartosik
(74) *Attorney, Agent, or Firm*—Fish & Associates, PC

(57) ABSTRACT

An interlocking tile system comprises tiles that has a body, interlocking cap structure with a first surface and a second surface; a first curved portion connecting the first surface with a radius of $R_1$ to the second engaging surface with a radius of $R_2$, wherein $R_1>R_2$; and a stem supporting the cap structure. The cap is a mushroom-like shape. Such configuration of the connector aids in installation by lessening instances of binding and align and guide the caps into their corresponding receiving areas. The tiles are preferably square, and are connected along all four sides.

7 Claims, 5 Drawing Sheets

INTERLOCKING FLOOR TILES WITH MUSHROOM SHAPED CONNECTORS

This application also claims priority to U.S. provisional application Ser. No. 60/776586 filed Feb. 24, 2006.

FIELD OF THE INVENTION

The field of the invention is modular floor tiles.

BACKGROUND

Interlocking modular tiles provide a quick and easy option to cover a variety of sizes and shaped surface areas. Simple assembly of the tiles allows users to quickly restore and enhance surface appearance of any undesirable characteristics of the floor surface, such as stains and markings. Usually made of durable material, the tiles also serve as a protective layer of existing floor surface.

There are many known modular tiles with interlocking elements addressing all manner of various needs. U.S. Pat. No. 5,791,114 to Mandel (Aug. 1998) describes quick assembly interlocking tiles having generally T-shaped connectors. U.S. Pat. No. 6,588,167 to Chang (July, 2003) in which the interlocking elements have a different configuration. U.S. Pat. No. 6,526,705 to MacDonald (March 2003) provides tile with different configuration connectors. While there exist many other tile configurations, many of these are merely for decorative purposes and do not take into consideration the problem of binding, which often exists during installation. Since the connectors have to interlock exactly, slight variations of the tiles tend to grind or "bind" together, causing the tiles to poorly fit around each other. Some of the configuration also creates the problem in which the connectors do not interlock tightly and can cause the floor modules to become disconnected with each other. As one unit of the interlocking tile binds the other, the whole surface of tiles can be uneven, unfitted and unsafe.

Thus, there is still a need for improvements to interlocking tiles that allow for greater flexibility and easy of use.

This and all other referenced patents and applications are incorporated herein by reference in their entirety. Where a definition or use of a term in a reference, which is incorporated by reference herein is inconsistent or contrary to the definition of that term provided herein, the definition of that term provided herein applies and the definition of that term in the reference does not apply.

SUMMARY OF THE INVENTION

The present invention provides modular floor covering systems and methods in which interlocking tiles have mushroom shaped connectors, allowing the tiles to be relatively free from undesirable binding during installation, and providing improved alignment and guidance of the connectors into corresponding receiving tiles.

In a preferred embodiment, a tile has a body and an interlocking cap structure with a first surface and a second surface; a first curved portion connecting the first surface with a radius of $R_1$ to the second engaging surface with a radius of $R_2$, wherein $R_1>R_2$; and a stem supporting the cap structure. The cap has a mushroom-like shape.

The stem also a second surface and a third surface contiguous to the body of the stem. Furthermore, the stem has a second curved portion connecting the second surface with a radius of $R_3$ to the third engaging surface with a radius of $R_4$, wherein $R_3<R_4$.

In another preferred embodiment, a system for covering a surface has a tile having a body and an interlocking cap structure having a first surface and a second surface; a first portion connecting the first surface with an angle of $L_1$ to the second engaging surface with an angle of $L_2$, wherein $L_1>L_2$, where ($L_1+L_2\leqq 180°$), and a stem supporting the cap structure.

The stem also has the second surface and a third surface. The second portion connecting the stem to the second surface has an angle of $L_3$ and the third engaging surface connecting to the stem has an angle of $L_4$, and $L_3<L_4$.

In preferred embodiments, the body of the tile also has a pattern and a grid around the pattern. The pattern can be raised from the rest of the body. The pattern can be of a square, diamond or other desired shape, The patterns, if raised, is at least 0.04 inches higher than the rest of the grid or the body.

In yet another preferred embodiment, a floor block has a grid portion defining a cap structure and a plurality of raised pattern that collectively reduce the thickness of the block by a factor of at least 20% relative to corresponding block without the grid portion.

Contemplated interlocking tiles can be fabricated from any suitable material, including for example polycarbonate, plastic, rubber or other polymeric material.

DETAILED DESCRIPTION

The present inventive subject matters provides a modular floor covering system with interlocking tiles that are relatively free from undesirable binding during installation, and providing improved alignment and guidance of the connectors into corresponding receiving tiles.

Figure 1:
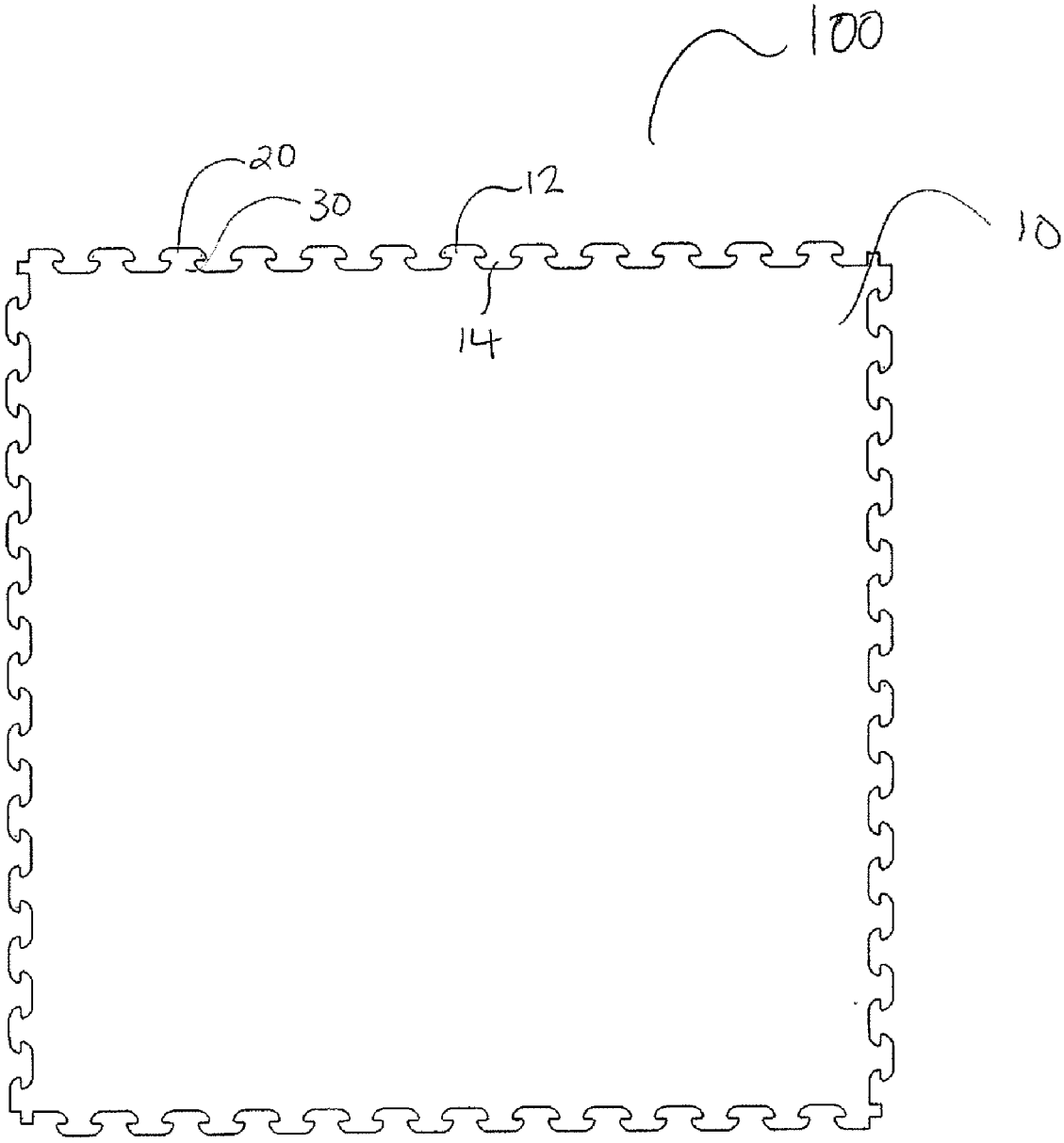
FIG. 1 is a plain view of an interlocking tile.
Figure 2:
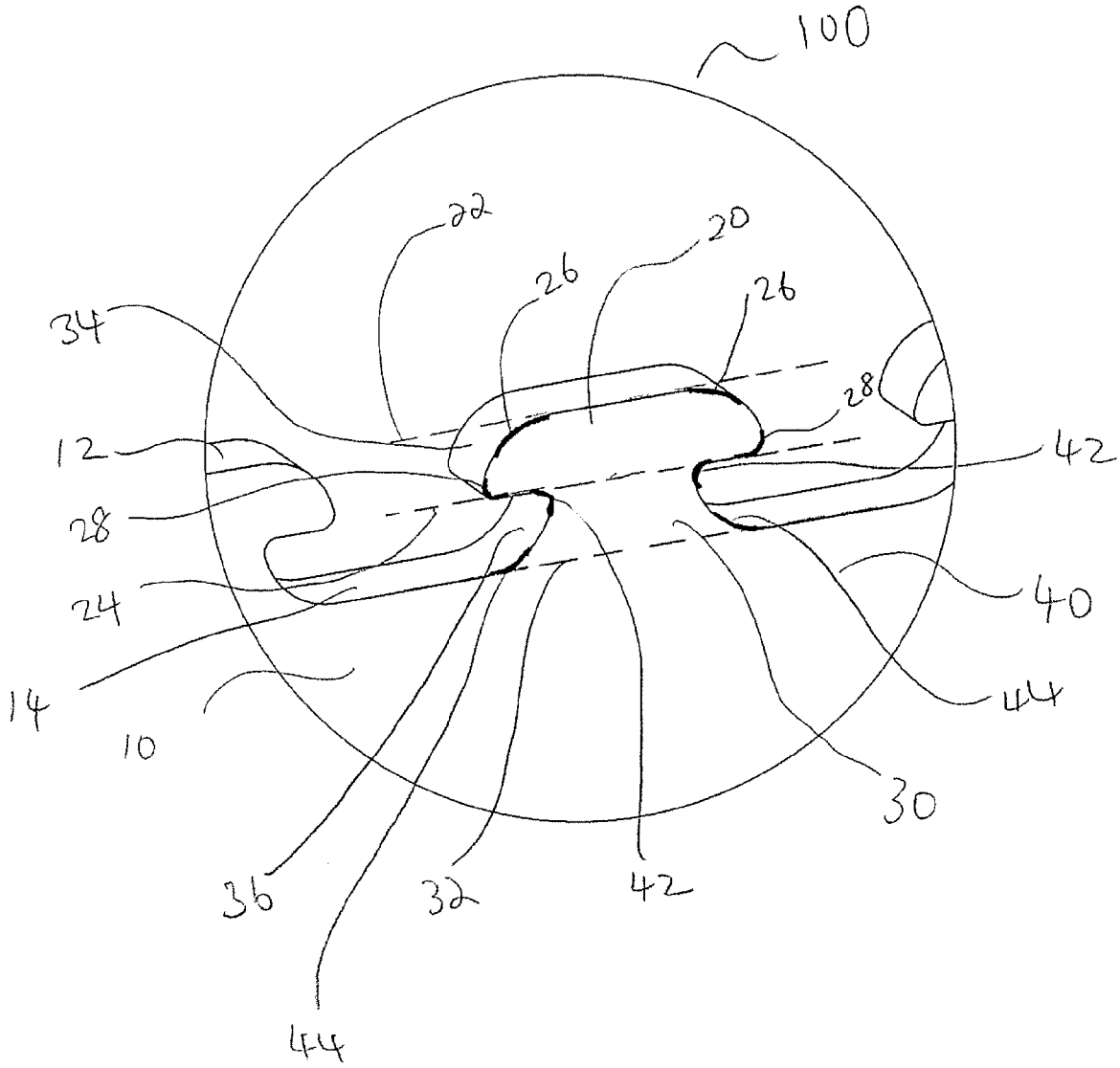
FIG. 2 is a close-up perspective view of the interlocking tile.

In FIG. 1 and FIG. 2, a modular floor covering system 100 generally comprises tile 10, cap 20 and stem 30.

FIG. 2 demonstrates a close-up view of cap 20 and stem 30 on tile 10. Cap 20 is preferably is a male protruding portion 12 that mates with another tile's female receiving portion 14. Male protruding portion 12 are connectors of tile 10 and can join other tile by mating with the female receiving portion.

Preferably, cap 20 comprises two regions: top region 22 and middle region 24. Top region 22 extends across the cap from one side to another. Similarly, bottom region 28 extends from the based of the cap from one side to the other. Outer edge 34 joins from one side of top region 22 and middle region 24 to form a curve and then joins the other side of top region 22 and middle region 24, and together form a generally mushroom-shape cap structure.

Preferably, outer edge 34 connects with top region 22 to form an arch to form an ellipse shape with first radius 26.

Then outer edge 34 preferably curves downward to connect with middle region 24 to form another ellipse with second radius 28. The downward curves allow for a mushroom-cap like shape, which also preferably means that top radius 26 is greater than middle radius 28.

Generally, a circle is defined by one point and the distance radius, R. However, it is preferred that the arch formed by joining outer edge 34 with top region 22 and middle region 24 is of an ellipse. The ellipse is a natural extension of the circle. Instead of having one radius, the ellipse has two points from one given point. Thus, the ellipse is the sum of distances from two radius R1 and R2 from the two points to the one given point. The two points are also called the foci of the ellipses. Top radius 26 is the larger radius of the ellipse formed by joining edge 34 to top region 22 then middle radius 28 which is joined by outer edge 34 to middle region 24.

The ellipse shape on both sides of the cap allow for the cap to form a mushroom-like shape. More importantly, the ellipse shape allows for the tiles to move relatively freely with each other for installation and use. Since most of the tile are used for floor covering have to withstand heavy foot traffic and use, the tiles have to interlock seamlessly. Existing interlocking modular floor fails to allow binding in which the tiles have some freedom in mating.

Contiguous to cap 20, stem 30 supports cap 20 and form a seamless interlocking unit to tile 10. Similar to cap 20, stem 30 has middle region 24 and bottom region 32 joined by inner edge 36. Middle region 24 extends from one side to the other of the stem and the bottom region 32 extends from one tile to another to form a female receiving portion 14. Female receiving portion 14 receives male protruding portion 10 of another tile to form an interlocking mating mechanism.

Preferably, an inverted arch is formed joining inner edge 36 with middle region 24 and bottom region 32. Similar to the cap, the stem forms an ellipse shape with third radius 42 formed by joining inner edge 36 with middle region 24 and fourth radius 44 formed by joining inner edge 36 with bottom region 32. Here, preferably, fourth radius 44 is larger than third radius 42. Logically, third radius 42 is the same length as second radius 28, and first radius 26 is the same length as fourth radius 42. The difference is that the curve is inverted for first and second radius as opposed to third and fourth radius. The inverted curve allows for the mating mechanism of the female receiving portion to the male protruding portion.

Preferably, the tiles have the male protruding portion and female receiving portion all along the edges to interlock with other tiles. However, it is contemplated that there are pieces where at least one edge of the tile does not have any male protruding portion or female receiving portion. For instance, tiles that are placed on the outer edge against a straight floor do not need to have connectors.

Figure 3A:
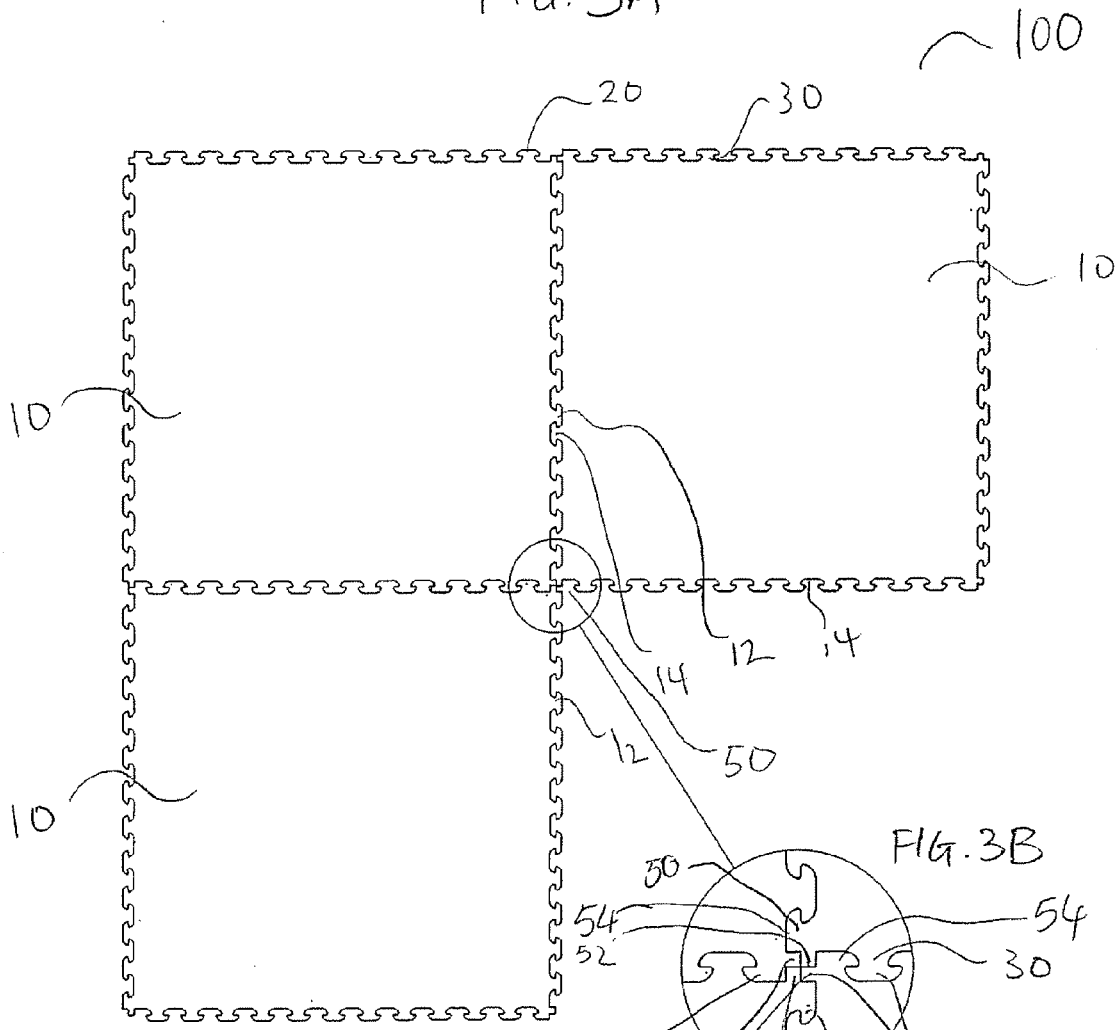
FIG. 3A is a plain view of the interlocking tiles mating together.
Figure 3B:
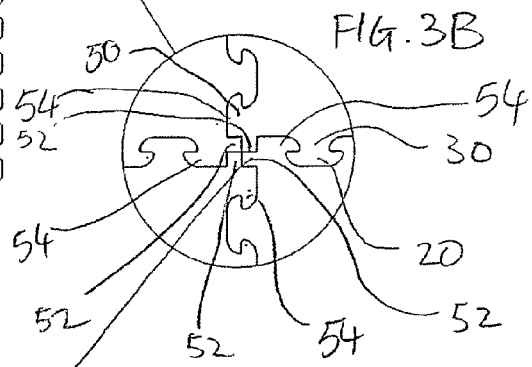
FIG. 3B is a closed up view of the joining pieces of the interlocking tiles.
Figure 3C:
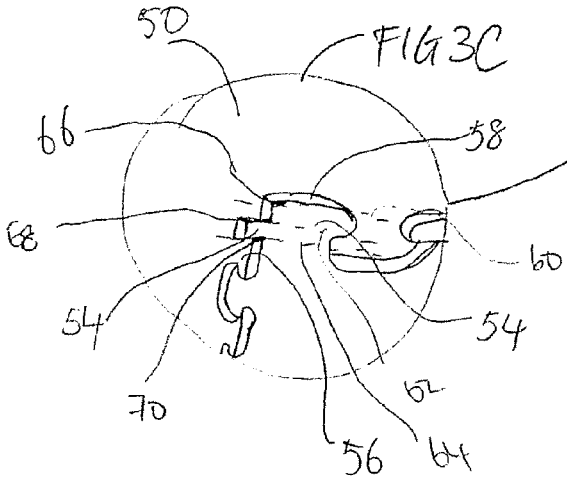
FIG. 3C is a side cross-section view of the corner piece of the interlocking tile.

In FIGS. 3A, 3B and 3C, a modular floor covering system 100 comprises the joining of tiles 10 by interlocking male protruding portions 12 of the individual tile to female receiving portions 14 of the adjoining tile.

FIG. 3B and FIG. 3C specifically depicts the joining of corner pieces 50. Corner pieces in general comprises corner male protruding portions 58 mating corner female receiving portion 56. The corner male protruding portion generally is at the adjacent side of the female receiving portion.

Similar to male protruding portion 12 and female protruding portion 14, there is corner cap 54 and corner stem 52. The corner cap and stem are different than the other cap and stem pieces in that corner pieces have to accommodate the different configuration presented in a corner. Preferably, corner cap 54 retains the characteristics of cap 20 on one side of the cap. On the other side of the corner cap that joins another corner piece of an adjoining tile, there is no outer edge that joins top region with a first radius followed by the outer edge joining the bottom region with a second radius. Instead, the corner cap has corner side edge portion 58 that connects corner top region 60 to corner middle region 62 with corner angle 66. Corner angle preferably is a right angle or an angle of 90 degrees. Similarly for corner stem 52, corner inner edge 58 connects corner middle region 62 to corner bottom region 68 with corner angle 70. Again, corner angle 70 preferably is a right angle or an angle of 90 degrees. This configuration gives rise to a corner male protruding portion that allows for the mating to the female receiving portion of the adjoining tile. Corner male protruding portion is located on one corner of the tile and the female receiving portion is located at the other corner of the same tile. The 90 degree configuration allows the corner pieces to join together seamlessly yet still retain the mushroom-like shape on the tile to allow for extra room and movement.

Figure 4:
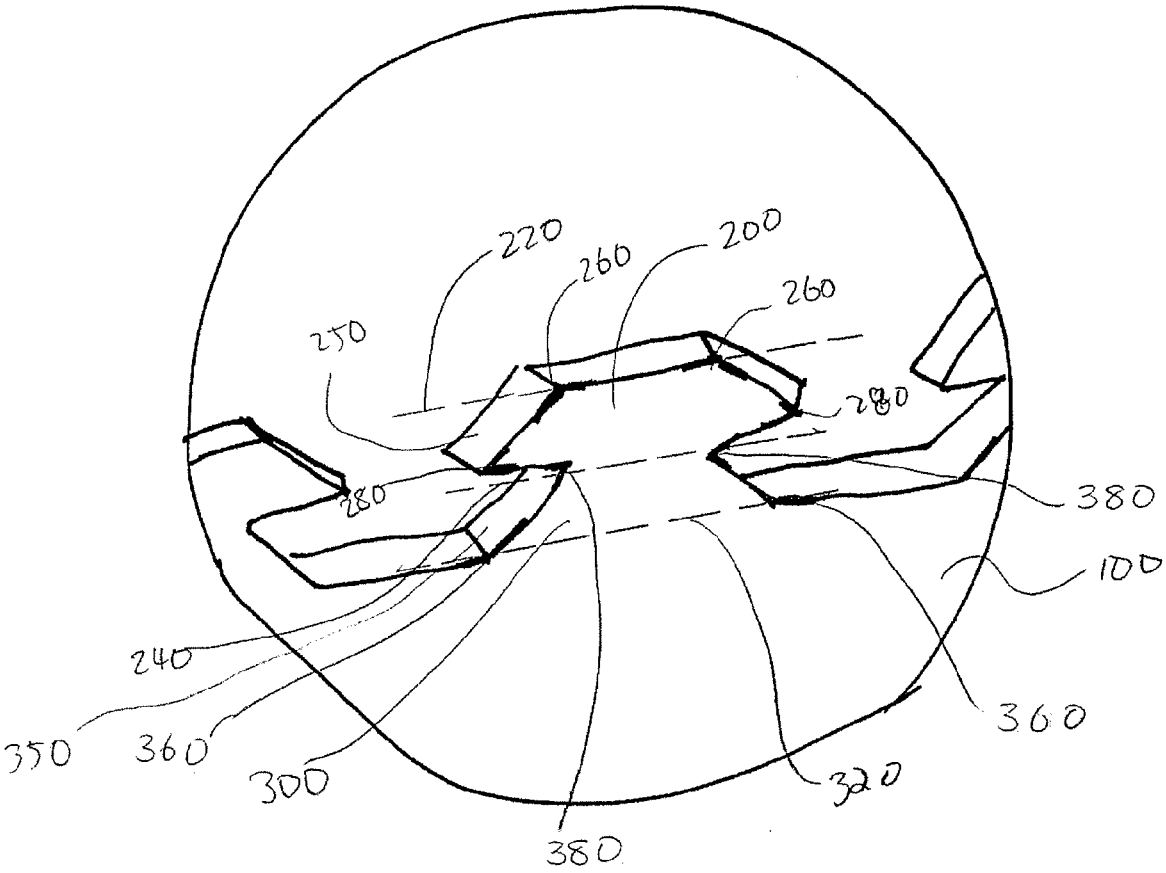
FIG. 4 is a plain view of an interlocking tile with a surface pattern.

Other configuration are also contemplated in that the shape contained is not just an ellipse or oval shape. It can be of an angular shape. As shown in FIG. 4, tile 100 comprises cap 200 with stem 300. Similar to a mushroom shape, cap 200 has top region 220 and middle region 240. Top region 220 extends across the cap from one side to another. Similarly, bottom region 280 extends from the based of the cap from one side to the other. Outer edge 250 joins from one side of top region 220 and middle region 240 to form instead of a curve, a angle, then joins the other side of top region 220 and middle region 240, and form the same angle.

Preferably, outer edge 250 connects with top region 220 to form a trapezoid-like shape with first angle 260. Then outer edge 250 preferably curves downward to connect with middle region 240 to form a straight line with that has second angle 280. First angle 260 preferably is greater than second angle 280. The sum of first angle and second angle should not exceed 180 degrees.

Contiguous to cap 220, stem 300 supports cap 220 and form a seamless interlocking unit for tile 10. Similar to cap 220, stem 300 has middle region 240 and bottom region 320 joined by inner edge 350. Middle region 240 extends from one side to the other of the stem and the bottom region 320 extends from one tile to another to form a female receiving portion. Female receiving portion receives male protruding portion of another tile to form an interlocking mating mechanism.

Preferably, a line is formed joining inner edge 350 with middle region 240 and bottom region 320. Similar to the cap, the stem forms the straight line with third angle 380 by joining inner edge 350 with middle region 240 and fourth angle 360 formed by joining inner edge 350 with bottom region 320. Here, preferably, fourth angle 360 is larger than third angle 380. Again, like first and second angle, the sum of third and fourth angle is no larger than 180 degrees.

In general, a modular floor system can have tiles that are made of one kind of material and have a smooth surface. It is contemplated, however, that the tile can have a surface pattern in which different shapes and sizes of patterns are set in the body of the tile.

Figure 5:
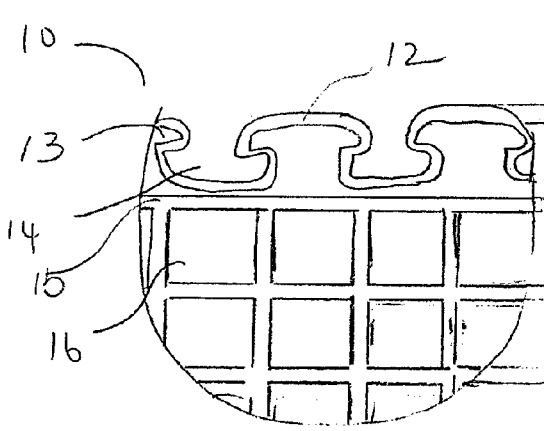
FIG. 5 is a vertical cross section view of the interlocking tile with the surface pattern.

As shown in FIG. 5, a tile 100 comprises connectors 13 that have male protruding portion 12 and female protruding portion 14 with body 13 in which pattern 16 is set with surrounding grooves 15. Specifically, pattern 16 is arranged in an orderly fashion that fills the body of the tile. Pattern 16 can be a square, rectangular, triangle, oval or any other desirable shape and pattern. It is also contemplated that the pattern 16 can comprises a combination of different shape within one tile.

Pattern 16 preferably are formed on the tile by mold injection. It is contemplated that when the tile is manufactured, the blocks or patterns are formed when the tile is formed. It is also possible that the basic mold of the tile with the mushroom-shape like caps and stems are formed first and then blocks and patterns are later on added onto the tile.

The modular floor covering system can be made of any suitable material or mixture of materials commonly known for floor covering, including clay, stone, wood, polymeric materials, recycled materials and especially material selected from the list consisting of vinyl, rubber, linoleum, and resin. Generally, a co-polymeric material is preferred for conventional modular flooring covering system.

For example, a preferred formulation of the modular floor covering system has PVC Resin: 32.8%; Calcium Carbonate: 24.9%; Dioctyl Phthalate: 39.8%; Lead (as lead stearate) 2.2%; Titianium Dioxide: 0.18%; Alumina: 0.11%; Benzophenone: 0.05% and dyes: 0.05%. In general, sporting flooring that requires greater use and abuse may require less expensive and synthetic rubber polymers. The mushroom-like shape of the tiles and the material flexibility provides a combinations of specific product application and requirement. It also provides for competitive cost advantages in the marketplace without comprising utility or quality.

Tiles can be any practical width, thickness, and length. With a given tile, the surface can be of one smooth material in which there are no ridges or grooves. With a patterned tile, the surface can contain ridges and grooves between the connectors and within the pattern as shown in FIG. 5. Cap can also be any practical width, thickness, and length that corresponds with the overall length, width, thickness of the tile. The width, thickness and length of pattern also can be flexible depending on the desired characteristics of the look and feel of the tiles.

Figure 6:
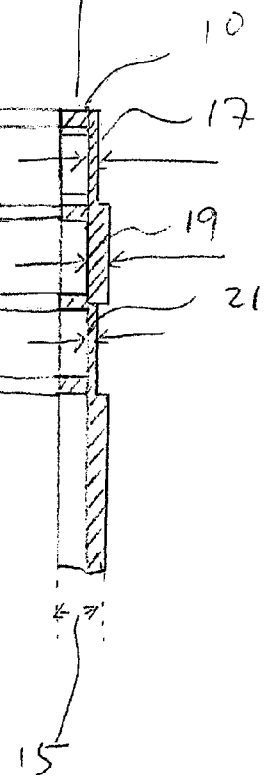
FIG. 6 is a close-up perspective view of an interlocking tile with a different configuration.

In one preferred embodiment as shown in FIG. 6, a side vertical cross section of the tile is shown. The thickness of tile preferably is at least 0.25 inches. It is contemplated that as long as the structural integrity of the tiles are maintained, the tiles can be any thickness. For example, tiles used for heavy duty sporting purposes is contemplated to have a greater thickness. Depending on the material formulation and construction, groove thickness 19 can be different than pattern thickness 21. Having groove thickness 19 be less than that of pattern thickness 21, at least 20% of material can be saved. Similarly, connector thickness 17 can also be less than the groove thickness and pattern thickness to save material. The patterns, if raised, preferably is at least 0.04 inches higher than the rest of the grid or the body to not only save material but maintain structural integrity.

Having the unique mushroom shape of the connectors allow for the tiles to interlock in a more efficient way. Tiles do not have to be aligned exactly during installation and yet they retain durability after installation. Even though the thickness of the connector is less, the structural integrity still stands with the present connector shape. It is also possible, although not desirable from a manufacturing cost standpoint, for different ridges on a given tile to be made of different materials, densities, shapes, colors and so forth.

It should be apparent to those skilled in the art that many more modifications besides those already described are possible without departing from the inventive concepts herein. Moreover, in interpreting the disclosure, all terms should be interpreted in the broadest possible manner consistent with the context. In particular, the terms "comprises" and "comprising" should be interpreted as referring to elements, components, or steps in a non-exclusive manner, indicating that the referenced elements, components, or steps could be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A system for covering a surface, comprising:

a tile having a body;

a plurality of identical interlocking structure extending from a side of the body, wherein each interlocking structure comprises a mushroom cap and a stem, wherein the mushroom cap includes a top portion extending from one side of the mushroom cap to another and a first curve connected to a second curve on each side of the top portion, the first curve having a $R_1$ radius and the second curve having an $R_2$ radius, $R_1$ being greater than $R_2$, and wherein the mushroom cap and the stem are symmetrical along an axis of the interlocking structure relative to the side;

a first area forms between each stem in a first shape that corresponds to the mushroom cap;

a second area forms between each mushroom cap in a second shape that corresponds to the stem; and a first and second comer displaced on opposite ends of the side, wherein the first comer has a comer cap and a comer stem and, wherein the second comer has a third and a fourth area to receive a third and a fourth shape that corresponds to the comer cap and the comer stem respectively.

2. The system of claim 1, wherein the tile comprises a polymeric material.

3. The system of claim 1 wherein the body comprises a grid and a plurality of raised pattern.

4. The system of claim 3, wherein the plurality of raised pattern is at least 0.04 in higher than the grid.

5. The system of claim 3, wherein the pattern comprises a square.

6. The system of claim 3, wherein the pattern comprises a diamond shape.

7. The system of claim 1, wherein the tile is at least 5 inches long.

* * * * *